US006402296B1

(12) United States Patent
Cleland et al.

(10) Patent No.: US 6,402,296 B1
(45) **Date of Patent: *Jun. 11, 2002**

(54) HIGH RESOLUTION INKJET PRINTER

(75) Inventors: Todd A. Cleland; Rio Rivas; David Pidwerbecki, all of Corvallis, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/183,549

(22) Filed: Oct. 29, 1998

(51) Int. Cl.[7] ..... B41J 2/145; B41J 2/15; B41J 2/14; B41J 2/16

(52) U.S. Cl. ..... 347/40; 347/47

(58) Field of Search ..... 347/40, 70, 14, 347/71, 47; 29/890.1

(56) References Cited

U.S. PATENT DOCUMENTS

| | | | | | |
|---|---|---|---|---|---|
| 4,374,707 | A | | 2/1983 | Pollack | 428/596 |
| 4,716,423 | A | | 12/1987 | Chan et al. | 347/65 |
| 4,773,971 | A | | 9/1988 | Lam et al. | 205/75 |
| 4,827,287 | A | | 5/1989 | Braun et al. | 347/75 |
| 4,829,319 | A | | 5/1989 | Chan et al. | 347/47 |
| 5,016,023 | A | * | 5/1991 | Chan et al. | 29/890.1 |
| 5,167,776 | A | | 12/1992 | Bhaskar et al. | 205/75 |
| 5,236,572 | A | | 8/1993 | Lam et al. | 205/75 |
| 5,255,017 | A | | 10/1993 | Lam | 347/47 |
| 5,600,351 | A | | 2/1997 | Holstun et al. | 347/40 |
| 5,610,637 | A | | 3/1997 | Sekiya et al. | 347/10 |
| 5,635,968 | A | | 6/1997 | Bhaskar et al. | 347/59 |
| 5,646,662 | A | * | 7/1997 | Kitahara | 347/70 |
| 5,719,602 | A | * | 2/1998 | Hackleman et al. | 347/14 |
| 5,729,257 | A | | 3/1998 | Sekiya et al. | 347/9 |
| 5,757,400 | A | * | 5/1998 | Hoisington | 347/40 |
| 5,851,274 | A | * | 12/1998 | Lin | 106/31.43 |
| 5,940,099 | A | * | 8/1999 | Karlinski | 347/70 |
| 5,984,455 | A | * | 11/1999 | Anderson | 347/47 |
| 6,146,915 | A | * | 11/2000 | Pidwerbecki et al. | 438/21 |

FOREIGN PATENT DOCUMENTS

| | | | | |
|---|---|---|---|---|
| EP | 0495663 A2 | | 1/1992 | B41J/2/14 |
| EP | 554907 | * | 8/1993 | 347/40 |

OTHER PUBLICATIONS

"The Second–Generation Thermal Inkjet Structure", by Ronald A. Askeland, Winthrop D. Childers, & William R. Sperry; Hewlett–Packard Journal; Aug. 1988; pp 28–31.

"The ThinkJet Orifice Plate: A Part With Many Functions", by Gary L. Siewell, William R. Boucher, & Paul H. McClelland; Hewlett–Packard Journal; May 1985; pp 33–37.

* cited by examiner

*Primary Examiner*—Thinh Nguyen

(57) ABSTRACT

A high resolution printer includes a printhead having optimized features including 12 to 14 micron diameter orifices spaced apart from adjacent orifices by a distance of between 76 to 94 microns. The orifice plate is electroformed and plated to a thickness ranging from 20 to 25 microns. A polymeric barrier layer secures the orifice plate to a printhead substrate.

10 Claims, 6 Drawing Sheets

A-A

HIGH RESOLUTION INKJET PRINTER

BACKGROUND OF THE INVENTION

The present invention is generally related to components which comprise a high-resolution inkjet printer and is more particularly related to a printhead capable of a large number of dots-per-inch (dpi) placement of ink on a medium for a high-resolution printer.

Simply stated, inkjet printers operate by expelling a small volume of ink through a plurality of small orifices in an orifice plate held in proximity to a paper or other medium upon which printing or marks are to be placed. These orifices are arranged in a fashion in the orifice plate such that the expulsion of droplets of ink from a selected number of orifices relative to a particular position of the medium results in the production of a portion of a desired character or image. Controlled repositioning of the orifice plate or the medium followed by another expulsion of ink droplets results in the creation of more segments of the desired character or image. Furthermore, inks of various colors may be coupled to individual arrangements of orifices so that selected firing of the orifices can produce a multi-colored image by the inkjet printer.

Several mechanisms have been employed to create the force necessary to expel an ink droplet from a printhead, among which are thermal, piezoelectric and electrostatic mechanisms. While the following explanation is made with reference to the thermal inkjet expulsion mechanism, the present invention may have application for the other ink expulsion mechanisms as well.

Expulsion of the ink droplet in a conventional thermal inkjet printer is a result of rapid thermal heating of the ink to a temperature that exceeds the boiling point of the ink solvent to create a vapor phase bubble of ink. Such rapid heating of the ink is generally achieved by passing a pulse of electric current, typically for one to three microseconds, through an ink ejector that is typically an individually addressable heater resistor. The heat generated thereby is coupled to a small volume of ink held in an enclosed area associated with the heater resistor and which is generally referred to as a firing chamber. For a printhead, there are a plurality of heater resistors and associated firing chambers—perhaps numbering in the hundreds—each of which can be uniquely addressed and caused to eject ink upon command by the printer. The heater resistors are deposited in a semiconductor substrate and are electrically connected to external circuitry by way of metalization deposited on the semiconductor substrate. Further, the heater resistors and metalization may be protected from chemical attack and mechanical abrasion by one or more layers of hard and non-reactive passivation. Additional description of basic printhead structure may be found in "The Second-Generation Thermal Inkjet Structure" by Ronald Askeland, et al. in the Hewlett-Packard Journal, August 1988, pages 28–31. Thus, one of the boundary walls of each firing chamber consists of the semiconductor substrate (and typically one firing resistor). Another of the boundary walls of the firing chamber, disposed opposite the semiconductor substrate in one common implementation, is formed by a foraminous orifice plate. Generally, each of the orifices in this orifice plate is arranged in relation to a heater resistor in a manner in which enables ink to be directly expelled from the orifice. As the ink vapor nucleates inoculates at the heater resistor and expands, it displaces a volume of ink which forces a lesser volume of ink out of the orifice for deposition of the medium. The bubble then collapses and the displaced volume of ink is replenished from a larger ink reservoir by way of an ink feed channel in one of the boundary walls of the firing chamber.

As users of inkjet printers have begun to desire finer detail in the printed output from a printer, the technology has been pushed into a higher resolution of ink droplet placement on the medium. One of the common ways of measuring the resolution is the measurement of the maximum number of ink dots deposited in a selected dimension of the printed medium, commonly expressed as dots per-inch (dpi). The production of an increased number of dots per inch requires smaller droplets. Smaller ink droplets means lowered drop weight and lowered drop volume for each droplet. Production of low drop weight ink droplets requires smaller structures in the printhead. Merely making structures smaller, however, ignores the fact that complex interactions between the various structures make the optimization of a printhead design quite complex. Thus, it is desirable that an optimization be reached so that improved resolution may be realized with acceptable throughput and cost.

Conventionally, an orifice plate for a thermal inkjet printer printhead is formed from a sheet of metal perforated with a plurality of small holes leading from one side of the metal sheet to the other. There has also been increased use of a polymer sheet through which holes have been created by ablation or other means. In the metal orifice plate example, the process of manufacture has been well described in the literature. See, for example, Gary L. Siewell, et al., "The Think Jet Orifice Plate: A Part With Many Functions", Hewlett-Packard Journal, May 1985, pages 33–37; Ronald A. Askeland, et al., "The Second-Generation Thermal Inkjet Structure", Hewlett-Packard Journal, August 1988, pages 28–31; and U.S. Pat. No. 5,167,776 "Thermal Inkjet Printhead Orifice Plate and Method of Manufacture".

It is axiomatic in thermal inkjet printer printheads that the orifice plate thickness be no less then approximately 45 microns thick. Orifice plates thinner then 45 microns suffer the serious disadvantage of being too flimsy to handle, likely to break apart in a production environment, or likely to become distorted by heat processing of the printhead. Orifice plates are typically manufactured by electroforming nickel on a mandrel and subsequently plated with a protecting metal layer.

A thick orifice plate (45 microns or thicker) generally requires a large heater resistor to provide the necessary force to expel a small droplet of ink past the relatively thick orifice layer and toward the medium. In comparison to small droplets: large structures such as these are inappropriate for those desired for high-resolution printing. U.S. patent application Ser. No. 08/920,478 "Reduced Size Printhead for an Inkjet Printer" filed on behalf of Pidwerbecki, et al. on Aug. 29, 1997, offers one solution to the obtaining of an orifice plate. This solution, however, does not provide the total answer to the problem, particularly when the higher resolution demanded it of a printer requires further optimization of all of the structures of a printhead. It is desirable, therefore, that optimization of the structures of a printhead be optimized so that higher resolutions, resolutions equivalent to 600 dpi or greater, be developed and incorporated into a commercially practical printhead.

SUMMARY OF THE INVENTION

A printhead for an inkjet printer provides high-resolution printing by employing a substrate including at least one ink ejector on its surface and an orifice plate affixed to the substrate. The orifice plate has a plurality of orifices disposed through it from a first surface proximate the surface of the substrate to a second surface distal to the surface of the substrate. The orifice plate has a thickness in the range of 20 to less than 25 microns and at least two orifices of the plurality of orifices having centers at the second surface spaced apart by a distance having a range of 76 to 94 microns. Each of the at least two orifices has an orifice opening at the second surface with a diameter having a range of 12 to 14 microns.

DETAILED DESCRIPTION OF THE PREFERRED EMBODIMENTS

Figure 1A:
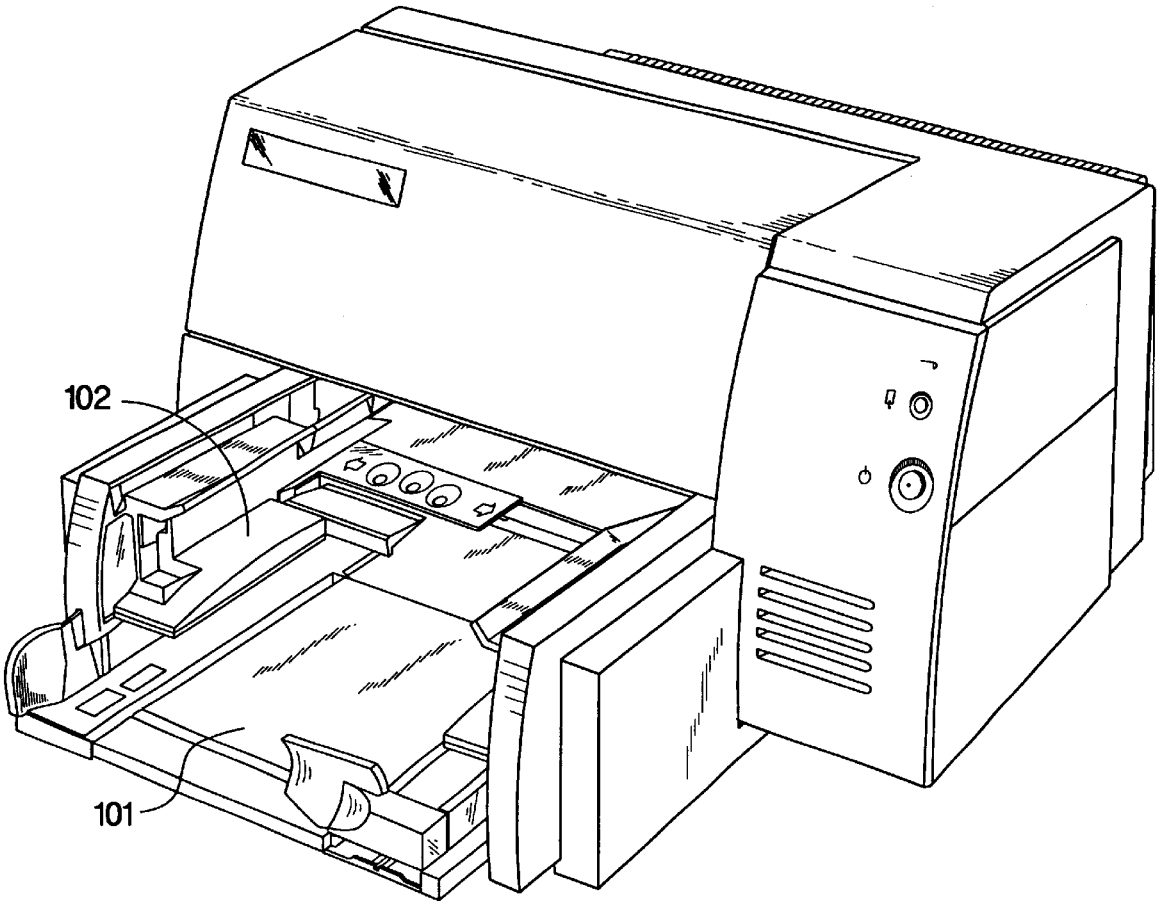
FIG. 1A is an isometric drawing of a typical printer which may employ the present invention.
Figure 1B:
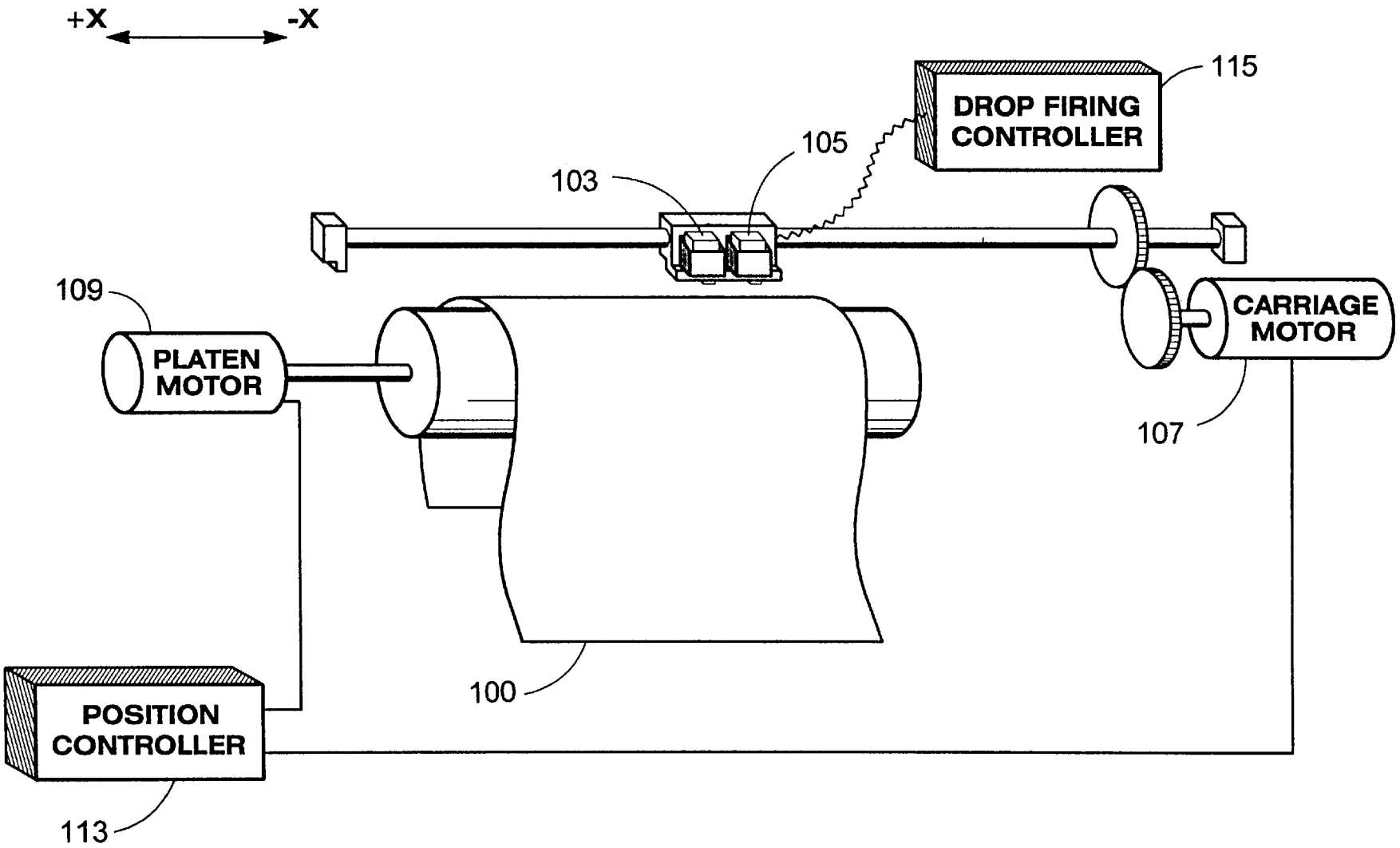
FIG. 1B is a diagram of the basic operational elements of the printer of FIG. 1A.

In order to achieve the desirable performance described above, a printhead disposed on a print cartridge for use in an inkjet printer is optimized to provide print resolutions of 600 dpi or greater in a printing system. An inkjet printer which may employ the present invention is illustrated in the isometric drawing of FIG. 1A. While the illustrated printer is similar to a DeskJet model 890C available from Hewlett-Packard Company, other inkjet printers having different configurations and modes of operation may profitably benefit from the present invention. Paper or other media, which may be printed upon, is stored in the input tray 101. Referring to FIG. 1B, a single sheet of media is advanced into the printer print area by a platen motor 109 and held against a platen. One or more inkjet print cartridges 103, 105 are incrementally drawn across the medium 100 on the platen by a carriage motor 107 in a direction perpendicular to the direction of entry of the medium. The platen motor 109 and the carriage motor 107 are typically under the control of a media and cartridge position controller 113. An example of such positioning and control apparatus may be found described in U.S. Pat. No. 5,070,410. Thus, the medium 100 is positioned in a location so that the print cartridges 103 and 105 may eject droplets of ink to place dots on the medium as required by the data that is input to a drop firing controller 115 of the printer. These dots of ink are expelled from selected orifices in a printhead element of selected print cartridges in a band parallel to the scan direction as the print cartridges 103 and 105 are translated across the medium by the carriage motor 107. When the print cartridge 103 and 105 reach the end of their travel at an edge of the medium 100, the medium is typically incrementally advanced by the media and cartridge position controller 113 and the platen motor 109. Once the print cartridges have reached the end of their traverse in the X direction on a bar or other print cartridge support mechanism, they are either returned back along the support mechanism while continuing to print or returned without printing. The medium may be advanced by an incremental amount equivalent to the width of the ink ejecting portion of the printhead or some fraction thereof. Control of the medium, positioning of the print cartridge, and selection of the correct ink ejectors for creation of an ink image or character is determined by the controller 113 which may be implemented in a conventional electronic hardware configuration. Once printing of the medium is complete, the medium is advanced into the output tray 102 for user removal. See for example "Color Thermal Inkjet Printer Electronics" by Jennie L. Hollis et al., Hewlett-Packard Journal, August 1988, pages 51–55; "Integrating the Printhead into the HP DeskJet Printer" by J. Paul Harmon et al., Hewlett-Packard Journal, October 1988, pages 62–66; and "DeskJet Printer Chassis and Mechanism Design", by Larry A. Jackson et al., Hewlett-Packard Journal, October 1988, pages 67–75.

Figure 2:
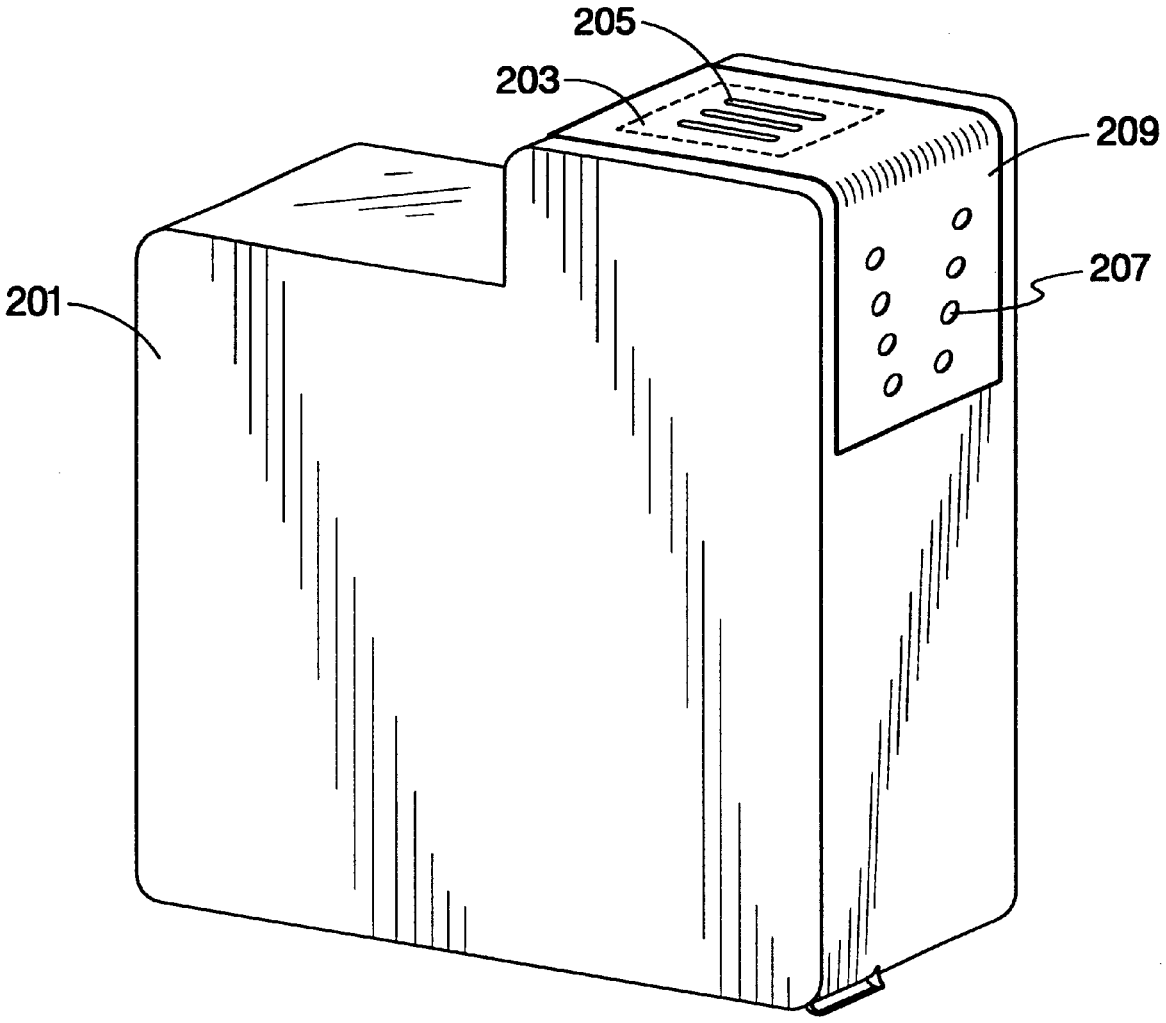
FIG. 2 is an illustration of a multi-color inkjet print cartridge which may be employed in the printer of FIG. 1 and which may utilize the printhead of the present invention.

An inkjet print cartridge which may be employed in the printer of FIG. 1 is represented in the drawing of FIG. 2. A cartridge body member 201 houses a supply of ink and includes internal passageways to route the ink to a printhead 203 via ink conduits. In an embodiment of the present invention which is adapted for multi-color printing, three groupings of orifices, one for each color (cyan, magenta, and yellow), is arranged on the surface of the printhead. One such orifice grouping is identified as grouping 205. Ink is selectively expelled for each color under control of commands from the printer that are communicated to the printhead 203 through electrical connections 207 and associated conductive traces (not shown) on a flexible polymer tape 209. These conductive traces are coupled to the metalization on the semiconductor substrate of the printhead for coupling to each ink ejection mechanism. In a preferred embodiment of an inkjet print cartridge, the printhead is constructed from a semiconductor substrate, including thin film heater resistors disposed in the substrate, a photo definable barrier and adhesive layer, and a foraminous orifice plate that has a plurality of orifices extending entirely through the orifice plate. Physical and electrical connections from the substrate are made to the polymer tape 209 by way of being lead bonding or similar semiconductor technology and are subsequently secured by an epoxy-like material for physical strength and fluid rejection. In the preferred embodiment, the polymer tape 209 is formed of Kapton™ commercially available from 3M Corporation, but a similar material that can be photo-ablated or chemically etched to produce openings and other desirable characteristics may also be used. Copper or other conductive traces are deposited or otherwise secured on one side of the tape so that electrically interconnections 207 can be contacted with the printer and routed to the substrate. In the preferred embodiment, the tape is typically bent around an edge of the print cartridge as shown and secured.

Figure 3:
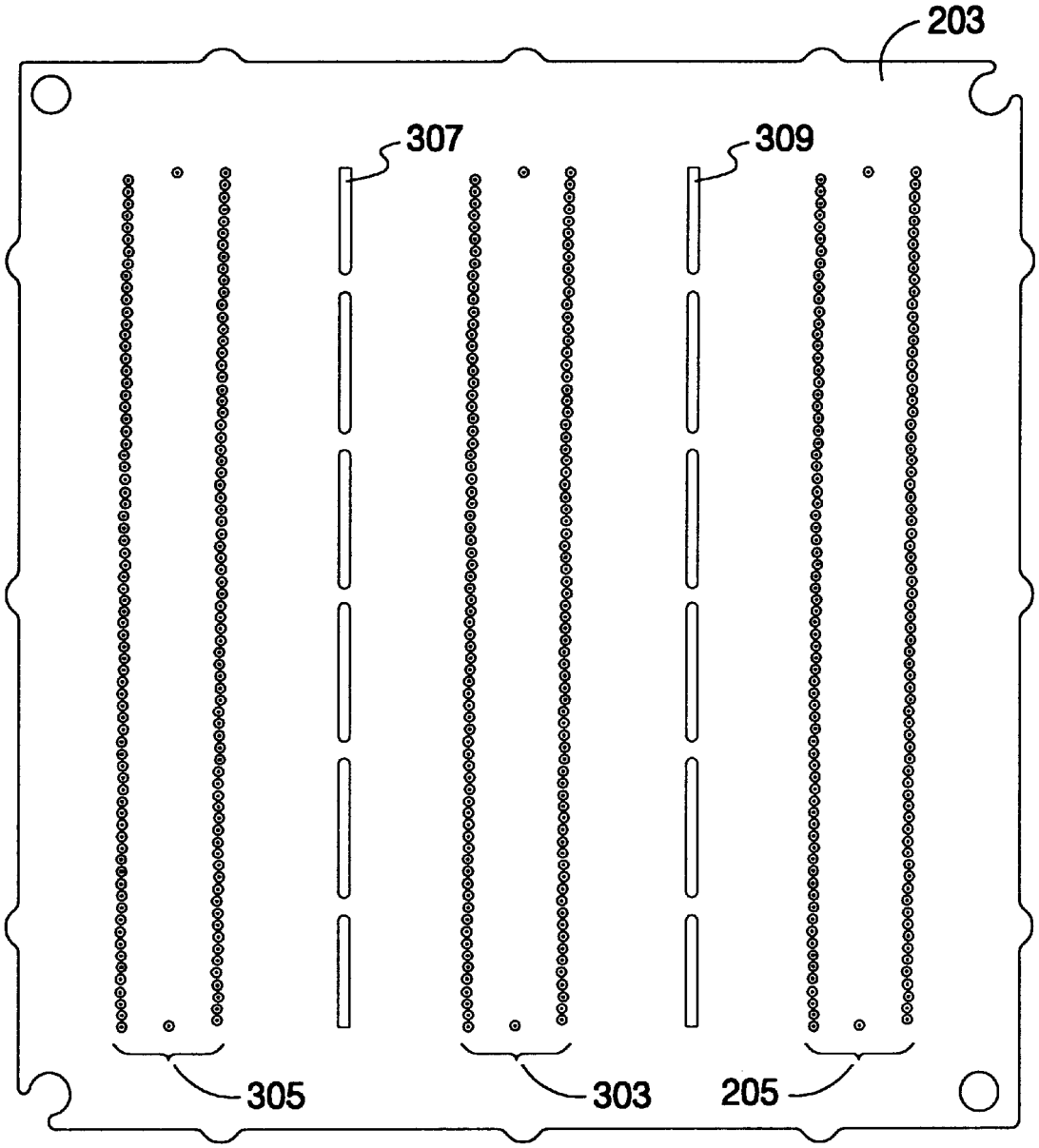
FIG. 3 is a plan view of a multi-color printhead illustrating a multiplicity of ink-emitting orifices arranged in three-color groups and in two linear rows for each group.

A planar view of the outer surface of the printhead 203 is shown in the diagram of FIG. 3. Three groupings of nozzles, 205, 303 and 305, (one grouping for cyan, one grouping for magenta, and one grouping for yellow) are visible. In the preferred embodiment, each grouping consists of two parallel lines of orifices, each line consisting of 72 individual orifices. Careful observation of FIG. 3 reveals that there is a slight stagger between neighboring orifices relative to a true straight line. This stagger enables the orifices to be placed closer together along the line of orifices as well as reducing the amount of fluidic cross-talk between neighboring orifices when the ink ejector is activated for any one of the firing chambers associated with the orifice. Although the lines of orifices casually appear parallel to each other, a slight stagger between neighboring orifices in each line is present and provides a higher density of dot placement. In a typical implementation, ink is fed to each firing chamber associated with each orifice by being fed through a slot in the semiconductor substrate (not shown) that is disposed essentially between the two parallel lines of orifices shown for each color. Expansion joints, for example joints 307 and 309, are added to the orifice plate to reduce stress in the assembled printhead structure and provide better planarity to be realized across the width of the printhead. In the preferred embodiment, the printhead is approximately 7,500 microns long (in the direction parallel to the lines of orifices) and 7,000 microns in width.

Figure 4:
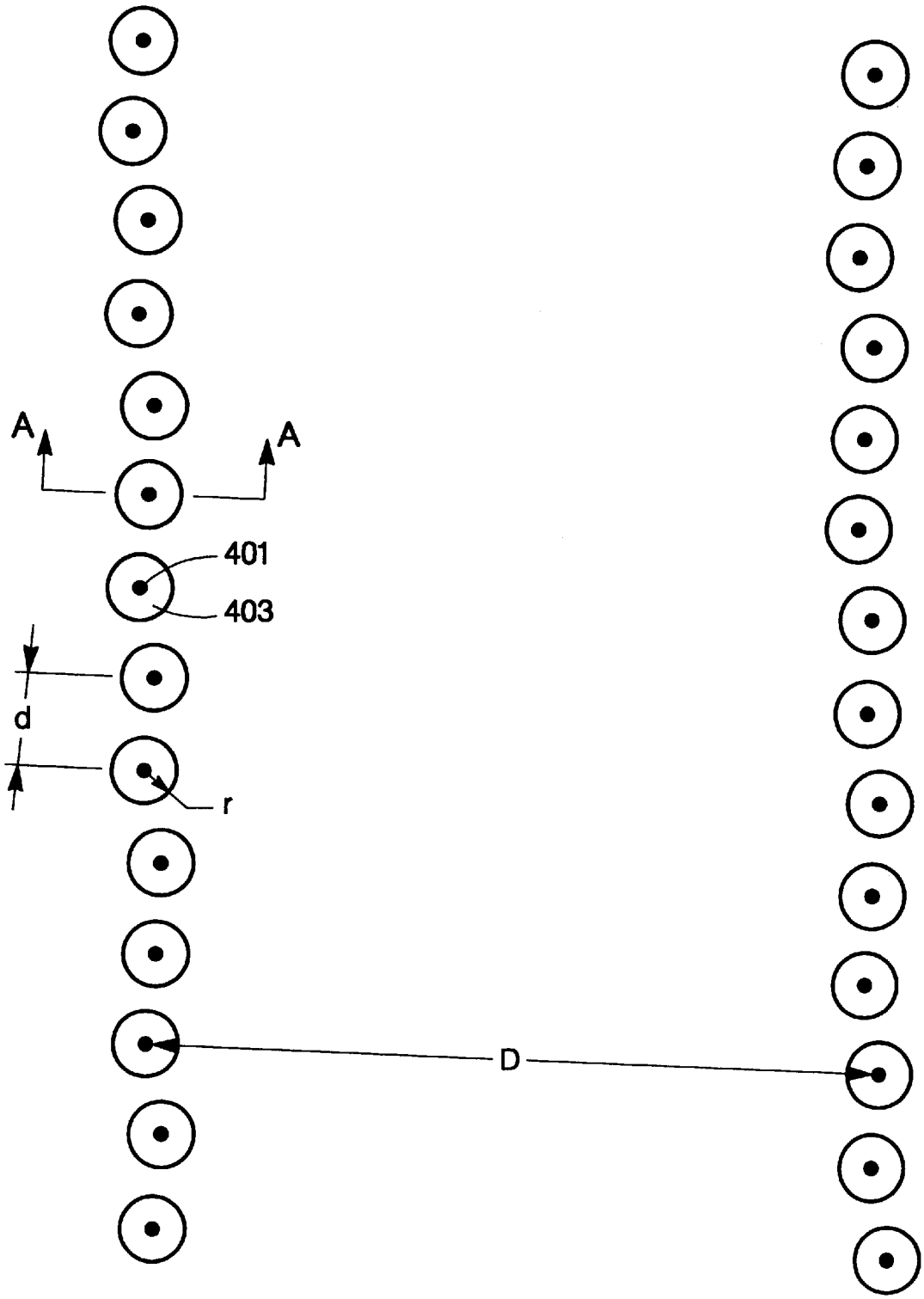
FIG. 4 is an enlarged plan view of the printhead surface illustrated in FIG. 3 and illustrating some of the interrelationships of the ink emitting orifices of the printhead.

A close-up of a portion of the outer surface of the printhead is shown in the plan view of FIG. 4. In a view of this magnification, it is possible to identify the outer surface opening of the orifice bore 401 as well as being able to identify the indentation 403 which surrounds the opening of the orifice bore. The depressions 403 and others on the surface of the orifice plate have a radius, r, which ranges between 25 and 30 microns in the preferred embodiment. The distance, d, between the centers of the adjacent nozzle openings (which is equivalent to the centerline of the orifice running through the orifice plate) ranges between 76 and 94 microns in the preferred embodiment.

Figure 5:
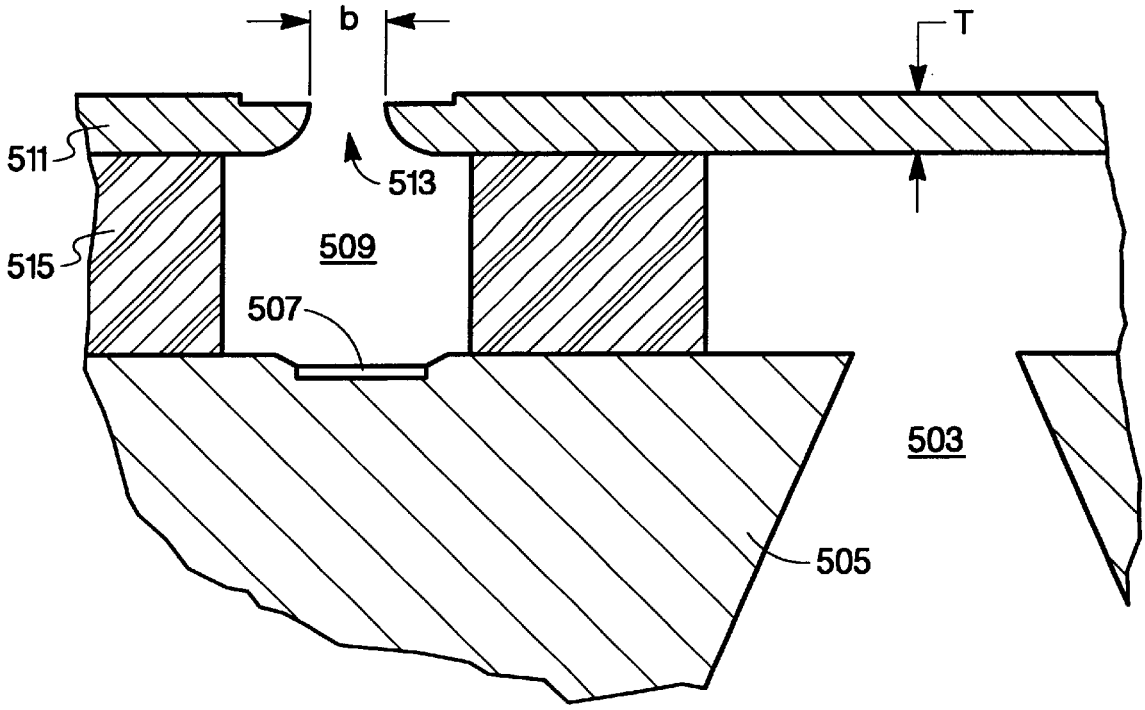
FIG. 5 illustrates a cross section of one firing chamber of the printhead of FIG. 4 as taken across section line A—A.

A cross section of one orifice and its associated firing chamber is shown in FIG. 5. This cross section is taken at A—A of FIG. 4. In the preferred embodiment, ink is supplied to the printhead by way of an ink slot 503 in the printhead substrate 505. The ink slot 503 may be located between the two lines of orifices as described previously, or two slots may be located on opposing sides of the lines of orifices. A thin film heater resistor 507 is disposed on one boundary wall of the firing chamber 509 and an opposite boundary wall is formed by the orifice plate 511 that positions the orifice 513 essentially over the heater resistor 507. In the preferred embodiment, a barrier material 515 is used to affix the orifice plate 511 to the semiconductor substrate 505 and further defines additional boundary walls of the firing chamber 509 as well as providing ink feed channels (not shown) to the firing chamber 509.

The orifice plate 511 is typically produced by electroforming nickel on a mandrel having insulating features with appropriate dimensions and suitable draft angles to produce the features desired in the orifice plate. Upon completion of a predetermined amount of time, and after a thickness of nickel has been deposited, the resultant nickel film is removed and treated for use as an orifice plate. The base nickel orifice plate is then coated with a precious metal such as gold, platinum, palladium, or rhodium to resist corrosion. Following its fabrication, the orifice plate is affixed to the semiconductor substrate 505 with the barrier material 515. The orifices created by the electroforming of the nickel on the mandrel extend from the inner surface of the orifice plate 511 to the outer surface of the orifice plate. It is a feature of the preferred embodiment that the orifices of the orifice plate, after treatment and plating, provide an opening on the outer surface of the orifice plate 511, diameter b, having a range of between 12 and 14 microns. The thickness, T, of the orifice plate is in the range of between 20 but less than 25 microns.

The substrate 505 and the orifice plate 511 are secured together by a barrier layer 515 as previously mentioned. In the preferred embodiment, the barrier layer 515 is disposed on the substrate 505 in a patterned formation such that firing chambers, such as chamber 509, are created in areas around the heater resistors. The barrier layer material is also patterned so that ink is supplied independently to the firing chambers 509 by one or more ink feed channels in the barrier material. In the preferred embodiment, the barrier layer 515 comprises of polymeric photo definable material such as Parad™, Vacrel™, or other materials such as those described in European Patent Application No. EP 0 691 206 A2 "Ink Jet Printhead Photoresist Layer Having Improved Adhesion Characteristics", published Jan. 10, 1986, which are a film negative, photo sensitive, multi-component, polymeric dry film which polymerizes with exposure to light or similar electromatic radiation. Materials of this type are available from E.I. DuPont deNemoirs Company of Wilmington Del.

Conventional orifice plates are manufactured on a mandrel as a square film electroform having a side dimension of approximately 12.7 centimeters and are subsequently separated from the mandrel. Nickel is the metal of choice for a printhead orifice plate because it is inexpensive, easy to electrform, and electroforms into intricate shapes. Of particular interest to those forming orifice plates, small holes can be conveniently created in the nickel plate by electrically insulating small portions of the otherwise conducting mandrel, thereby preventing electro deposition of nickel on what is an electrically conducting cathodic electrode in a modified Watts-type mixed anion bath. It is well known that a stainless steel mandrel can be laminated with a dry film positive photoresist in those areas where orifices and other features are to be formed. The photoresist is then exposed to ultra-violet light through a mask which, following development of the photoresist creates features of insulation such as pads, pillars, and dikes which will correspond to the orifices and other structures desired in the orifice plate. At the conclusion of a predetermined period of time related to the temperature in concentration of the plating bath, the magnitude of the DC current used for the plating current, and the thickness of the desired orifice plate, the mandrel and newly formed orifice plate electroform are removed from the plating bath, allowed to cool and the orifice plate electroform is peeled from the mandrel. Since stainless steel has an oxide coating, plated metals only weakly adhere to the stainless steel and the electroformed metal orifice plate can usually be removed without damage. The orifice plate electroform may then be separated or singulated into individual orifice plates for application to a printhead.

To produce orifice plates having thicknesses less than 45 microns, additional steps are required to overcome the flimsiness and fragility of such thin films. In the preferred embodiment, an extended heat treatment and soft sintering step is included in the orifice plate manufacturing process. These additional steps are further described in U.S. patent application Ser. No. 08/920,478, "Reduced Size Printhead for an Inkjet Printer" filed on behalf of Pidwerbecki, et al. on Aug. 29, 1997.

In the preferred embodiment, the nickel electroform is deposited to a thickness of approximately 20 microns which is subsequently overplated with approximately 2.4 microns of palladium. Other precious metals such as gold, rhodium, or platinum may also be used for corrosion protection of the nickel and the orifice plate can vary over a thickness range of from 20 microns to less than 25 microns.

Once the printhead is assembled, each line of orifices having the aformentioned dimensions and characteristics is capable of printing a 300 dpi resolution. For each color group, however, there are two lines of orifices separated by a distance, D, of approximately 660 microns ±10%. Furthermore, the orifices in one line are off-set in the direction parallel to that line by a distance of 42.4 microns relative to the orifices in the other orifice line of the color group so that dots placed on the medium by the second line of orifices will fall between the dots placed on the medium by the orifices in the first line of orifices. A staggered, two line printing nozzle configuration has been described in U.S. Pat. No. 5,635,968, "Thermal Inkjet Printer Printhead With Offset Heater Resistors", to Bhaskar et al. The printer is provided an operating algorithm which delays the printing of dots from the second line of orifices for a period of time long enough for the dots to be coordinated with the dots of the first line of orifices, in this way, a resolution of 600 dpi is achieved. Depending upon the operating algorithm of the printer, as the printhead is moved with relation to the medium to be printed upon, all of the dots necessary for a particular image or character may be printed as the motion proceeds in one direction. Alternatively, dots resulting from droplets ejected by one line of orifices may have interstitial dots placed by the second line of orifices as the printhead is moved first in one direction and then in another relative to the printed medium.

Thus by optimizing the thickness of the orifice plate, the diameter of the ink ejecting orifices, and the orifice to orifice spacing, one is able to realize a printhead and an inkjet printer employing the printhead having the ability to print high-resolution images and characters.

We claim:

1. A printhead for an inkjet printer providing high resolution printing, comprising:

a substrate including at least one ink ejector on a surface of said substrate;

a metal orifice plate having a plurality of orifices disposed through said orifice plate from a first surface proximate said surface of said substrate to a second surface distal to said surface of said substrate, said orifice plate having a thickness in the range of 20 to less than 25 microns and at least two orifices of said plurality of orifices having centers at said second surface spaced apart by a distance having a range of 76 to 94 microns and each of said at least two orifices having an orifice opening at said second surface with a diameter having a range of 12 to 14 microns; and a polymeric barrier layer securing the orifice plate to the substrate, said barrier layer defining a plurality of firing chambers each arranged in correspondence with a respective ink ejector, wherein high resolution inkjet printing is realized.

2. The printhead in accordance with claim 1 further comprising depressions surrounding each of said at least two orifices and having a radial dimension from said center of each of said at least two orifices having a range of 25 to 30 microns.

3. The printhead in accordance with claim 1 wherein at least a portion of said plurality of orifices are arranged in essentially two lines spaced apart from one another and disposed essentially parallel to one another.

4. The printhead in accordance with claim 3 wherein said two lines are spaced apart from each other by a distance having a range of 600 microns to 720 microns.

5. The printhead in accordance with claim 1 wherein the metal plate comprises nickel.

6. An inkjet printer having at least one printhead element for depositing ink with a high resolution upon a print medium, comprising:

a print medium support;

a printhead including a substrate including at least one ejector on a surface of said substrate and a metal orifice plate affixed to said substrate and having a plurality of orifices disposed through said orifice plate from a first surface proximate said surface of said substrate to a second surface distal to said surface of said substrate, said orifice plate having a thickness in the range of 20 to less than 25 microns and at least two orifices of said plurality of orifices having centers at said second surface spaced apart by a distance having a range of 76 to 94 microns and each of said at least two orifices having an orifice opening at said second surface with a diameter having a range of 12 to 14 microns;

a polymeric barrier layer securing the orifice plate to the substrate, said barrier layer defining a plurality of firing chambers each arranged in correspondence with a respective ejector;

a printhead support mechanism; and a controller to provide motion of the print medium support and printhead relative to each other and to cause activation of ink ejectors.

7. An inkjet printer according to claim 6 wherein said printhead further comprises a first depression surrounding one of said at least two orifices and a second depression surrounding another of said at least two orifices, both said first depression and said second depression having a radial dimension from respective said centers of said at least two orifices ranging from 25 to 30 microns.

8. An inkjet printer according to claim 6 wherein said printhead further comprises a first depression surrounding one of said at least two orifices and a second depression surrounding another of said at least two orifices, both said first depression and said second depression having a radial dimension from respective said centers of said at least two orifices ranging from 25 to 30 microns.

9. An inkjet printer in accordance with claim 8 wherein said two lines spaced apart from one another further comprise a spaced apart dimension having a range of 600 microns to 720 microns.

10. The printer in accordance with claim 6 wherein the metal orifice plate comprises nickel.

* * * * *